US009528393B2

(12) United States Patent
Huber et al.

(10) Patent No.: US 9,528,393 B2
(45) Date of Patent: Dec. 27, 2016

(54) METHOD AND GUIDE FOR REMOVING AN INNER CASING FROM A TURBOMACHINE

(71) Applicant: ALSTOM Technology Ltd, Baden (CH)

(72) Inventors: Tobias Christoph Huber, Waldshut (DE); Gerard Froidevaux, Neuenhof (CH); Daniel Seng, Busslingen (CH); Karsten Schwarz, Nussbaumen (CH)

(73) Assignee: GENERAL ELECTRIC TECHNOLOGY GMBH, Baden (CH)

( * ) Notice: Subject to any disclaimer, the term of this patent is extended or adjusted under 35 U.S.C. 154(b) by 563 days.

(21) Appl. No.: 14/022,550

(22) Filed: Sep. 10, 2013

(65) Prior Publication Data

US 2014/0072422 A1 Mar. 13, 2014

(30) Foreign Application Priority Data

Sep. 10, 2012 (EP) ..... 12183637

(51) Int. Cl.
*F01D 25/28* (2006.01)
*F04D 29/62* (2006.01)
(Continued)

(52) U.S. Cl.
CPC ..... *F01D 25/28* (2013.01); *F01D 25/285* (2013.01); *F04D 19/02* (2013.01); *F04D 29/624* (2013.01);
(Continued)

(58) Field of Classification Search
CPC ..... F01D 25/24; F01D 25/243; F01D 25/26; F01D 25/265; F01D 25/28; F01D 25/285; F27B 2007/2246; F27B 2007/2273; F05D 2230/68; F05D 2230/70
See application file for complete search history.

(56) References Cited

U.S. PATENT DOCUMENTS 3,141,651 A * 7/1964 Moyer ..... F01D 11/08 415/136
3,493,212 A * 2/1970 Scalzo ..... F01D 25/26 415/127
(Continued)

FOREIGN PATENT DOCUMENTS

CN 101096919 A 1/2008
CN 101611218 A 12/2009
(Continued)

*Primary Examiner* — Richard Edgar
*Assistant Examiner* — Christopher R Legendre
(74) *Attorney, Agent, or Firm* — Buchanan Ingersoll & Rooney PC

(57) ABSTRACT

The method for removing an inner casing from a machine such as a turbine or compressor includes providing supports between the outer casing and the inner casing of the machine, removing a top part of the outer casing, then removing a top part of the inner casing, then connecting a ring sector to a bottom part of the inner casing to replace the removed top part of the inner casing, then rotating the reciprocally connected ring sector and bottom part of the inner casing around the longitudinal axis to make the bottom part of the inner casing accessible, then removing the bottom part of the inner casing, guiding the reciprocally connected ring sector and bottom part of the inner casing during rotation, to prevent movement along the longitudinal axis.

7 Claims, 4 Drawing Sheets

(51) Int. Cl.
*F04D 29/64* (2006.01)
*F04D 19/02* (2006.01)

(52) U.S. Cl.
CPC ..... *F04D 29/644* (2013.01); *F05D 2230/68* (2013.01); *F05D 2230/70* (2013.01); *Y10T 29/49318* (2015.01); *Y10T 29/49321* (2015.01); *Y10T 29/49721* (2015.01); *Y10T 29/49815* (2015.01)

(56) References Cited

U.S. PATENT DOCUMENTS 4,925,363 A * 5/1990 Brown ..... F01D 25/26 384/547
6,079,943 A 6/2000 Sexton et al.
7,762,764 B2 * 7/2010 Peel ..... F02C 3/16 415/108
8,117,727 B2 * 2/2012 McCarvill ..... F01D 9/041 29/254
8,276,273 B2 * 10/2012 Shigemoto ..... F01D 25/26 29/402.03
9,162,329 B2 * 10/2015 Huber ..... B23P 15/04
2007/0175221 A1 8/2007 Trbojevic et al.
2011/0052426 A1 * 3/2011 Borer ..... F04D 17/122 417/247
2013/0326875 A1 * 12/2013 Black ..... F01D 25/285 29/888.01
2014/0072422 A1 * 3/2014 Huber ..... F01D 25/285 415/201
2014/0178183 A1 * 6/2014 Masuda ..... F04D 29/4206 415/173.1
2015/0267561 A1 * 9/2015 Huber ..... F01D 25/243 415/214.1
2015/0267563 A1 * 9/2015 Huber ..... F01D 25/26 29/700
2015/0308343 A1 * 10/2015 Scott ..... F01D 25/30 60/796
2015/0354597 A1 * 12/2015 I ..... F01D 25/246 415/209.3

FOREIGN PATENT DOCUMENTS

GB 1211313 11/1970
JP 08-296407 11/1996
JP 09-4411 1/1997
RU 2184879 C1 7/2002
WO 2006/103152 10/2006
WO 2008/012195 1/2008

* cited by examiner

METHOD AND GUIDE FOR REMOVING AN INNER CASING FROM A TURBOMACHINE

CROSS-REFERENCE TO RELATED APPLICATIONS

This application claims priority to European Application 12183637.3 filed Sep. 10, 2012, the contents of which are hereby incorporated in its entirety.

TECHNICAL FIELD

The present invention relates to a method and a guide for removing an inner casing from a turbomachine.

The turbomachine is in general a machine having an outer casing, an inner casing within the outer casing and a rotor within the inner casing. For example, such a machine is an axial turbine or an axial compressor etc.

BACKGROUND

Turbomachines such as axial turbines or compressors have an outer casing that houses an inner casing; the inner casing carries vanes. Within the inner casing a rotor is housed that carries blades.

Blades and vanes must withstand very heavy operating conditions, thus they need periodical checking and controls.

Different methods are known to access the vanes and blades.

For example the upper part of the outer casing and inner casing can be removed and then also the rotor can be removed, in order to access the vanes at the bottom part of the inner casing.

Nevertheless, removing the rotor is very time consuming, thus it is preferably avoided.

In addition it is known to remove the upper part of the outer and inner casing, replace the upper part of the inner casing with a ring sector and then providing rollers between the bottom part of the outer and inner casing.

This way the bottom part of the inner casing can be rotated on the rollers, bringing it at the top of the machine, such that it can be removed without removing the rotor.

The publication GB 1211313 discloses the implementation of a roller support structure for rotatably supporting the inner casing within the lower half of the outer casing. Through at least one aperture in the lower half of the outer casing the roller structure is insertable into the clearance between outer and inner casing.

The published application WO 2006103152 discloses diverse embodiments for replacing structural components of an axial turbomachine based on roller structures in the lower half of the outer casing. According to one embodiment in a first step the upper half of the inner casing is removed, in a second step the removed component is replaced by an auxiliary half ring, in a third step this auxiliary half ring is connected to the lower casing half and finally rotating the lower half and the auxiliary ring around the rotational axis until the lower half reaches an accessible area.

Even though these methods have some advantages, nevertheless damages between the adjacent parts of the inner and outer casing have been found. Tilting and axial shift of the inner casing relative to the outer casing leads to reduced clearance between the outer and the inner casing with the consequence of damages, such as fretting during roll out. To avoid this disadvantage, it is important to exactly define the axial position of the center of mass and to locate the roller support structure exactly at this axial position. But due to casting tolerances and other influences the center of mass may have shifted with the consequence of a risk of serious damages during roll out of the casing.

Both publications are silent how to avoid this disadvantage.

A further development of the solutions, as specified in the above-cited documents, discloses WO 2008012195. To maintain an exact alignment of the inner casing during its 180°-rotation around the machine axis the arrangement of two roller groups at different axial positions is proposed. Instead of one roller support at the axial position of the center of mass two roller groups, disposed at a distance to each other and on both sides of the center of mass, are applied. Though this solution avoids tilting of the casing the problem of avoiding axial shift is not solved.

SUMMARY

An aspect of the disclosure includes providing a method and a guide by which when removing the inner casing without removing the rotor, the inner casing maintains an exact alignment to the machine axis to ensure that adjacent parts are not damaged during roll out.

These and further aspects are attained by providing a method for removing an inner casing from a machine having an outer casing, and inner casing within the outer casing, a rotor within the inner casing, the rotor having a longitudinal axis, the method including:

- providing supports between the outer casing and the inner casing,
- removing a top part of the outer casing, then
- removing a top part of the inner casing, then
- connecting a ring sector to a bottom part of the inner casing to replace the removed top part of the inner casing, then
- rotating the reciprocally connected ring sector and bottom part of the inner casing around the longitudinal axis to make the bottom part of the inner casing accessible, then
- removing the bottom part of the inner casing, axially guiding the reciprocally connected ring sector and bottom part of the inner casing during rotation, to prevent movement along the longitudinal axis.

In a first refinement guiding includes providing a guide cooperating with the ring sector and/or inner casing bottom part to limit axial movement.

In particular, at least the connected ring sector includes a circumferential contour with two opposite axially facing surfaces, and at least one contact element for interaction with at least one of the facing surfaces.

In another refinement, providing a guide includes adjusting the guide configuration along longitudinal axis.

In addition, these and further aspects are also attained by providing a guide for removing an inner casing from a machine having an outer casing, and inner casing within the outer casing, a rotor within the inner casing, the rotor having a longitudinal axis, the guide including:

- a circumferential contour with at least one axially facing surface on the inner casing,
- a body,
- at least one restraining arm extending from the body and carrying a slidable contact element for interaction with said axially facing surface of the inner casing.

In a first refinement, the guide comprises adjustment connectors between the at least one restraining arm and the body for axial alignment of the restraining arm.

In another refinement, the guide comprises two restraining arms extending from the body, the two restraining arms having slidable contact elements for an interaction with the opposite axially facing surfaces of the circumferential contour on the inner casing.

In another refinement, the slidable contact elements are rotatable slidable contact elements.

In a further refinement, the rotatable slidable contact elements are rotatable bearings.

BRIEF DESCRIPTION OF THE DRAWINGS

Further characteristics and advantages will be more apparent from the description of a preferred but non-exclusive embodiment of the method and guide, illustrated by way of non-limiting example in the accompanying drawings, in which.

DETAILED DESCRIPTION

Figure 1:
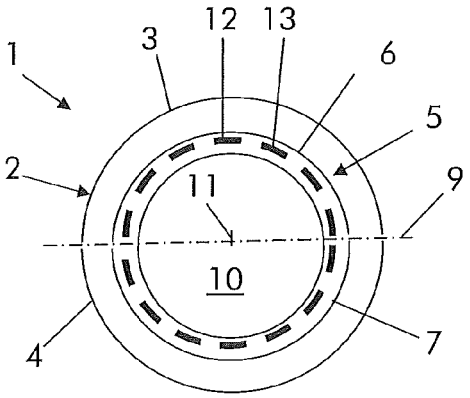
FIGS. 1 through 7 show the steps of the process.

The machine 1 is for example an axial turbine (such as a turbine of a gas turbine engine or steam turbine) or an axial compressor and includes an outer casing 2 with a top part 3 and a bottom part 4 and an inner casing 5 with a top part 6 and a bottom part 7. The top and bottom parts 3, 6, 4, 7 of the outer and inner casings 2, 5 are divided by a horizontal axis 9; in addition the top and bottom parts 3, 6, 4, 7 are connected together for example by screws or bolts or other means.

The inner casing 5 houses a rotor 10 with a longitudinal axis 11.

The inner casing 5 has vanes 12 and the rotor 10 has blades 13.

In order to remove the inner casing 5 without removing the rotor 10 the following steps are carried out.

Figure 2:
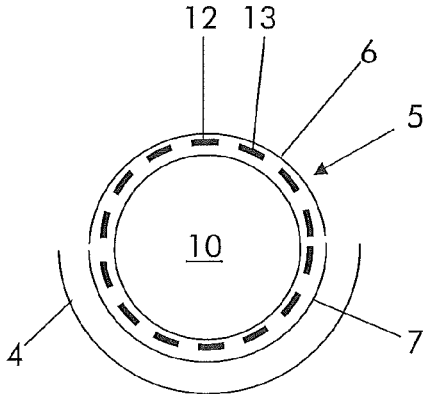

The top part 3 of the outer casing 2 is removed (FIG. 2), then

Figure 3:
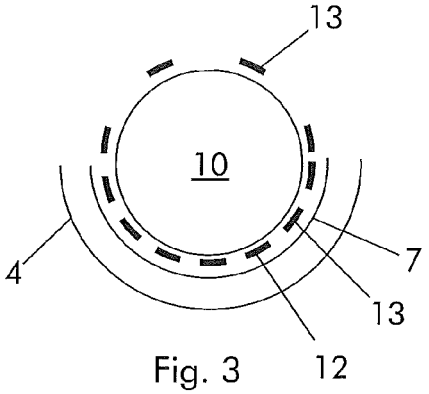
Figure 4:
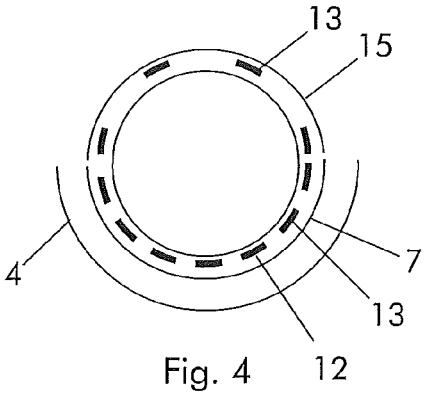
Figure 5:
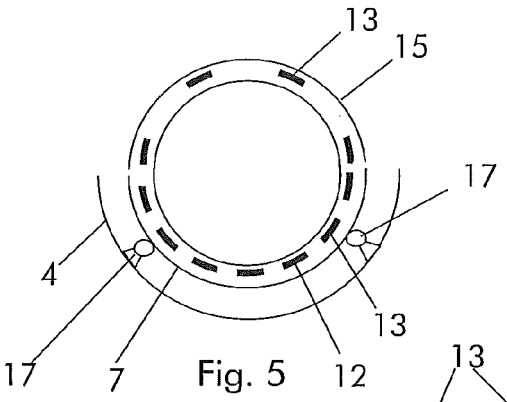
Figure 6:
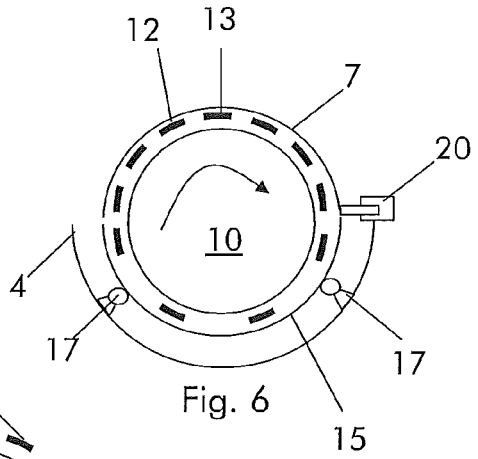
Figure 7:
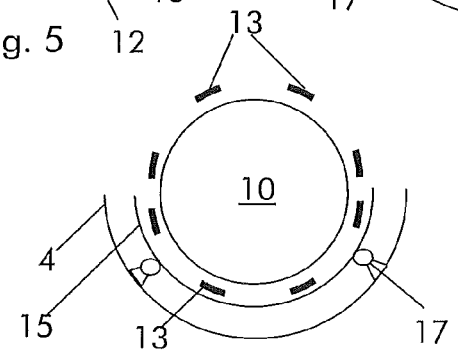
Figure 8:
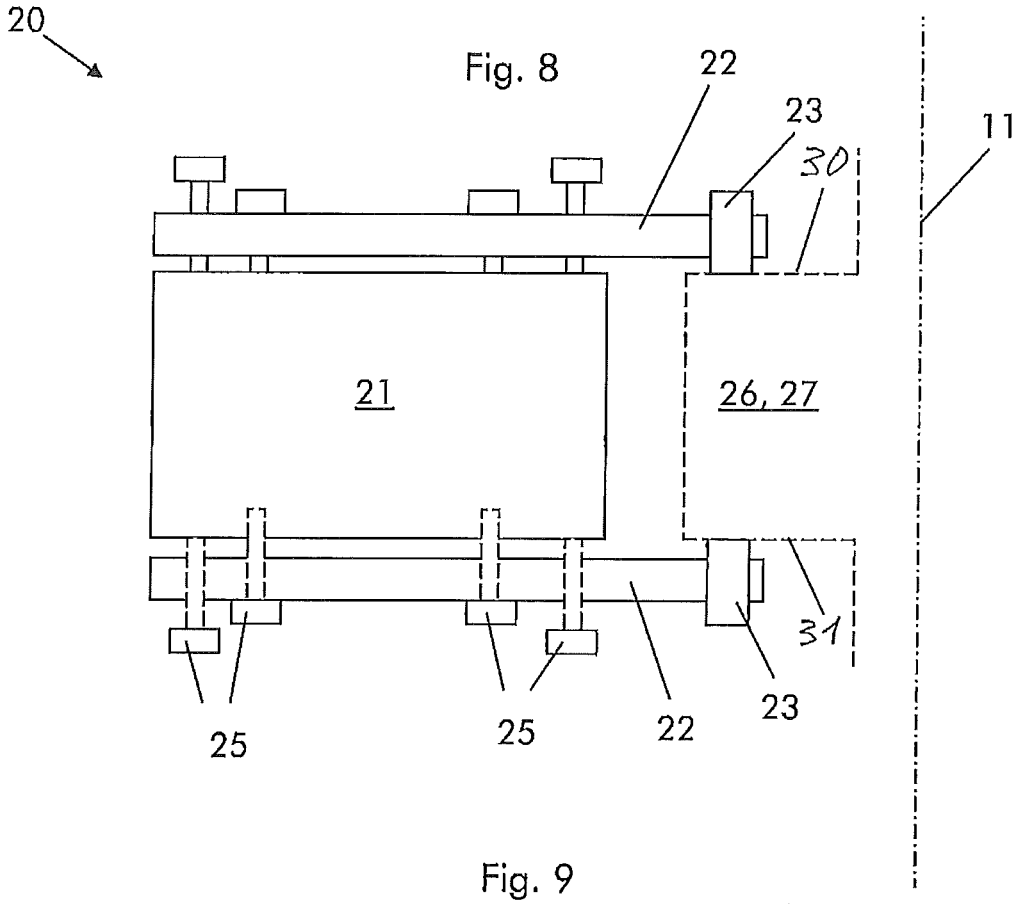
FIG. 8 shows the guide.
Figure 9:
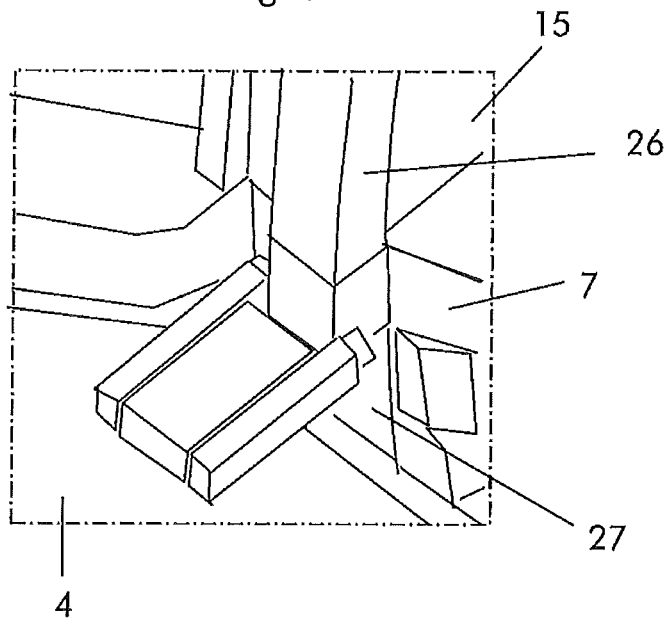
FIG. 9 is a perspective view of the guide connected to an inner casing (in particular a bottom part thereof) and/or ring sector.
Figure 10:
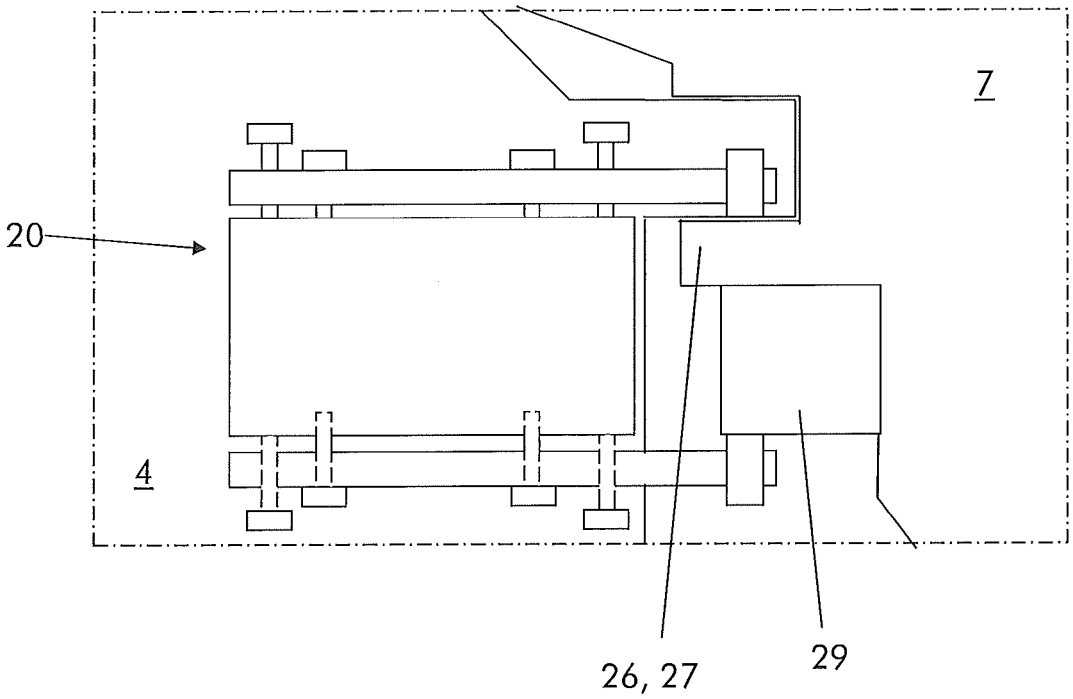
FIG. 10 is a top view of the guide connected to an inner casing (in particular a bottom part thereof) and/or ring sector and FIG. 11 is a schematic side view of a turbomachine showing the guide according to the invention in working position.

- the top part 6 of the inner casing 5 is removed (FIG. 3), then
- a ring sector 15 is connected to the bottom part 7 of the inner casing 5 (FIG. 4) to replace the removed top part 6 of the inner casing 5,
- supports 17 (for example ball or roll supports or guides for a sliding contact or also other kinds of supports) are provided between the bottom part 4 of the outer casing 2 and the bottom part 7 of the inner casing 5 at least nearby its center of mass 32 (FIG. 5 and FIG. 11); this step can be carried out at any time for example also at the beginning of the process,
- thus the reciprocally connected ring sector 15 and bottom part 7 of the inner casing 5 are rotated around the longitudinal axis 11 by 180° to make the bottom part 7 of the inner casing 5 accessible (FIG. 6), then
- the bottom part 7 of the inner casing 5 is removed (FIG. 7).

Figure 11:
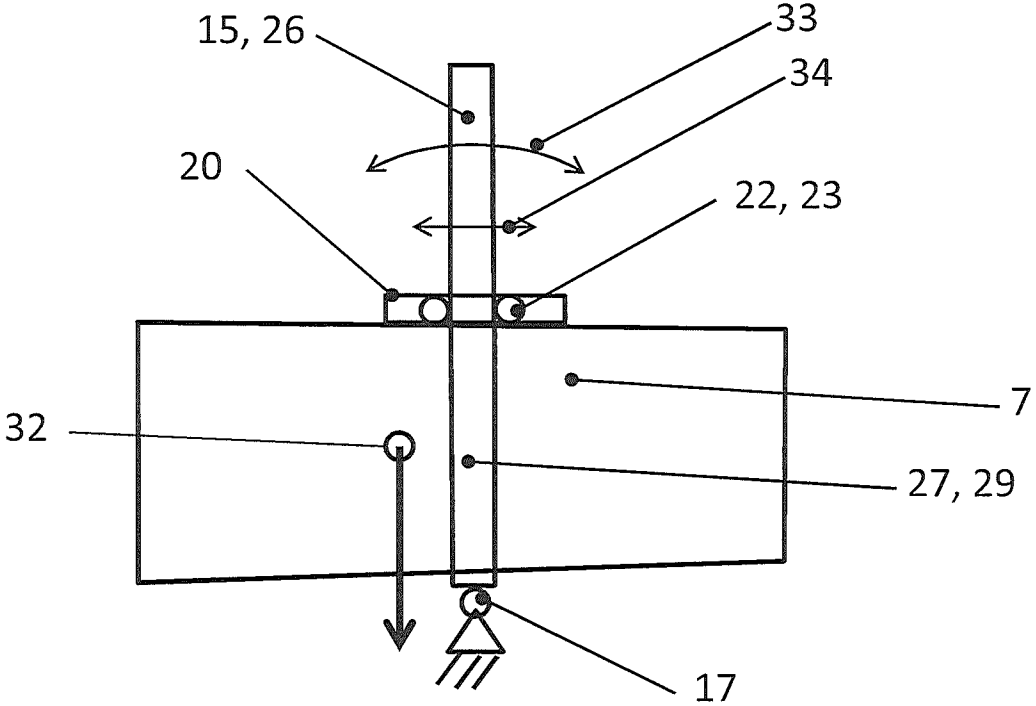

During rotation, the reciprocally connected ring sector 15 and bottom part 7 of the inner casing 5 are guided to prevent movement 33, 34 along the longitudinal axis 11 (FIG. 11).

Preferably, guiding includes providing a guide 20 cooperating with the ring sector 15 and/or inner casing bottom part 7.

Providing the guide 20 includes adjusting the guide configuration along the longitudinal axis 11.

The present disclosure also relates to the guide 20 for limiting axial movement of the inner casing 5 of the machine 1.

The guide 20 includes a body 21 and one or more restraining arms 22 (the figures show two arms) extending from the body 21 and carrying slidable contact elements 23.

In addition, the guide 20 comprises adjustment connectors 25 between the arms 22 and the body 21. These adjustment connectors allow adjustment of the axial position of the contact elements 23 on arms 22.

The restraining arms 22 extending from the body 21 face one another and have slidable contact elements 23 which interact with opposite axially facing surfaces 30, 31 at the circumferential contour 26, 27 of the ring sector 15 and/or the bottom part 7.

The term slidable contact elements 23 comprises slide elements as well as roller elements.

The operation of the guide is apparent from that described and illustrated and is substantially the following.

The guide 20 is connected to a fixed element, for example the guide 20 can be connected to the bottom part 4 of the outer casing 2 in the parting line, once the top part 3 of the same outer casing 2 has been removed (FIG. 6).

The restraining arm 22 or arms 22 and the slidable contact elements 23 are in contact with the axially facing surface(s) 30, 31 on an circumferential contour of the ring sector 15 and/or bottom part 7 of the inner casing 5. For example, the ring sector 15 and the bottom part 7 of the inner casing 5 can have protruding flanges 26, 27; the axial faces 30, 31 of these protruding flanges 26, 27 can be aligned such as to define a continuous surface on which the contact elements 23 slide.

In addition, if needed (according to the particular configuration of the relevant parts) an additional element 29 can be provided between the flanges 26 and/or 27 to allow optimal connection.

Thus the adjustment connectors 25 are adjusted, to define a correct axial position for the arms 22 and consequently to hinder axial movement of the inner casing 5, such that the inner casing cannot shift (see 34), and in addition, the adjustment connectors 25 allow to keep the longitudinal axis 11 of the rotor and the axis of the stator parallel, such that the inner casing 5 cannot tilt (see 33).

By the invention any contacts between

- blades and stator or stator heat shields (if provided), and/or
- vanes and rotor or rotor heat shields (if provided), and secondary damages are prevented.

In other words a small gap between the bottom parts 4, 7 of the outer and inner casing 2, 5 is provided and the guide keeps this gap during rotation of the ring sector 15 and bottom part 7 of the inner casing 5.

Thus the rotation of the ring sector 15 and bottom part 7 of the inner casing 5 can be carried out.

Naturally the features described may be independently provided from one another.

In practice the materials used and the dimensions can be chosen at will according to requirements and to the state of the art.

The invention claimed is:

1. A method for removing an inner casing from a machine having an outer casing, the inner casing within the outer casing, and a rotor within the inner casing, the rotor having a longitudinal axis, the method comprising:

providing supports between the outer casing and the inner casing;

removing a top part of the outer casing;

then removing a top part of the inner casing;

then connecting a ring sector to a bottom part of the inner casing to replace the removed top part of the inner casing;

then rotating the reciprocally connected ring sector and bottom part of the inner casing around the longitudinal axis to make the bottom part of the inner casing accessible;

then removing the bottom part of the inner casing;

guiding the reciprocally connected ring sector and bottom part of the inner casing during rotation, to prevent movement along the longitudinal axis, wherein guiding includes providing a guide cooperating with the ring sector and/or inner casing bottom part and adjusting a configuration of the guide along the longitudinal axis.

2. The method according to claim 1, wherein at least the ring sector includes a circumferential contour with two axially facing surfaces, and at least one contact element of said guide interacts with at least one of said axially facing surfaces.

3. A guide for removing an inner casing from a machine having an outer casing, the inner casing within the outer casing, a rotor within the inner casing, the rotor having a longitudinal axis, the guide comprising:

a body; and first and second restraining arms, each extending from the body, each restraining arm carrying respective first and second slidable contact elements having respective first and second contact surfaces for interaction with an axially facing surface on a contour of the inner casing wherein the first contact surface faces the second contact surface.

4. The guide according to claim 3, comprising:

adjustment connectors between the restraining arms and the body to define the axial position of each contact element.

5. The guide according to claim 3, comprising:

wherein the respective first and second slidable contact elements of the two restraining arms are configured to interact with two opposite axially facing surfaces of the circumferential contour of the casing.

6. The guide according to claim 3, wherein each slidable contact element is a slide element.

7. The guide according to claim 3, wherein each slidable contact element is a roller bearing.

* * * * *